US006003281A

United States Patent [19]

Pilakoutas

[11] Patent Number: 6,003,281

[45] Date of Patent: Dec. 21, 1999

[54] REINFORCED CONCRETE STRUCTURAL ELEMENTS

[75] Inventor: Kypros Pilakoutas, Sheffield, United Kingdom

[73] Assignee: The University of Sheffield, Sheffield, United Kingdom

[21] Appl. No.: 08/964,052

[22] Filed: Nov. 4, 1997

Related U.S. Application Data

[63] Continuation of application No. PCT/GB96/01508, May 3, 1996.

[30] Foreign Application Priority Data

May 4, 1995 [GB] United Kingdom ..... 9509115

[51] Int. Cl.[6] ..... E04C 5/06; E04C 5/16; E04B 5/43

[52] U.S. Cl. ..... 52/742.14; 52/745.19; 52/712; 52/649.1; 52/414

[58] Field of Search ..... 52/741.1, 745.19, 52/742.14, 742.15, 740.1, 719, 712, 649.1, 414, 251, 378, 309.11; 264/31, 35, 228, DIG. 64; 249/207, 213, 218

[56] References Cited

U.S. PATENT DOCUMENTS

| | | | |
|---|---|---|---|
| 1,035,323 | 8/1912 | Cummings | 52/649.1 |
| 1,684,195 | 9/1928 | Olmstead | 52/649.1 |
| 2,997,812 | 8/1961 | Weillet | 52/649.1 |
| 3,199,827 | 8/1965 | Terry | 52/251 X |
| 4,040,220 | 8/1977 | Henager | 52/745.19 X |
| 4,104,842 | 8/1978 | Rockstead et al. | 52/649.1 |
| 4,128,980 | 12/1978 | Abdallah | 52/251 |
| 4,245,926 | 1/1981 | Asszonyi et al. | 52/649.1 X |
| 4,253,288 | 3/1981 | Chun | 52/454 |
| 4,283,896 | 8/1981 | Fricker et al. | 52/309.11 X |
| 4,472,331 | 9/1984 | Kida | 264/31 |
| 4,624,089 | 11/1986 | Dunkaer | 52/309.11 |
| 4,854,106 | 8/1989 | Bogar | 52/719 |
| 4,999,965 | 3/1991 | Schmidgall et al. | 52/719 X |
| 5,058,345 | 10/1991 | Martinez | 52/309.11 |
| 5,181,359 | 1/1993 | Chana et al. | 52/253 |
| 5,248,122 | 9/1993 | Graham | 249/91 |

FOREIGN PATENT DOCUMENTS

| | | | |
|---|---|---|---|
| B-523559 | 8/1982 | Australia . | |
| 23737 | 4/1906 | Austria | 52/414 |
| 0781891 | of 0000 | European Pat. Off. . | |
| 401762 | 9/1909 | France . | |
| 1089669 | 3/1955 | France . | |
| 3331276 | of 0000 | Germany . | |
| 2035670 | 1/1972 | Germany | 52/719 |
| 292267 | of 1902 | United Kingdom . | |
| 100457 | of 1916 | United Kingdom | 52/251 |
| WO9719233 | of 0000 | WIPO . | |

*Primary Examiner*—Robert Canfield
*Attorney, Agent, or Firm*—Sheldon & Mak; Denton L. Anderson

[57] ABSTRACT

A shear failure reinforcing system for structural elements, in which thin elongate strips of high stiffness material are anchored around a layer of conventional reinforcement, and/or are anchored around a plurality of layers of conventional reinforcement, such that the strips tie the element and improve its resistance to shear failure.

21 Claims, 8 Drawing Sheets

S4

REINFORCED CONCRETE STRUCTURAL ELEMENTS

CROSS-REFERENCE

This is a continuation of International Application No. PCT/GB96/01508, with an international filing date of May 3, 1996, which claims priority from Great Britain Application No. GV 9509115.3, to the University of Sheffield, with a filing date of May 4, 1995, incorporated herein by reference in their entirety.

This invention relates to reinforced concrete structural elements, and more particularly to a reinforced concrete structural element having improved resistance to shear failure and to a method of providing shear reinforcement for a reinforced concrete structural element.

BACKGROUND OF THE INVENTION

Thin reinforced concrete elements, for example flat concrete slabs, provide an elegant form of construction, which simplifies and speeds up site operations, allows easy and flexible partitioning of space and reduces the overall height of buildings. Reinforced concrete flat slab construction also provides large uninterrupted floor areas within a minimum construction depth, and is used extensively for a wide range of buildings such as office blocks, warehouses and car parks.

One design problem associated with this form of construction is punching failure, which occurs as a result of high point loads or high shear stresses around the supporting columns. In punching failure, the failed surface of the slab forms a truncated cone or pyramid. This problem has in the past often lead to the use of mushroom heads or local thickening of the slab, but these solutions increase costs and slow down the rate of construction. As the spans become larger and the slabs become thinner the increased stresses around the critical shear perimeter have created even greater problems for the structural engineer. A variety of design solutions have been proposed, of which the most commonly used are as follows:

1. Conventional shear reinforcement

This solution is very labour-intensive and requires extra work both in the design and on site.

2. Use of a larger column and/or a thicker concrete slab

These solutions increase the deadload of the building and reduce the available space.

3. Use of a column head

This requires more complicated formwork, slows down the rate of construction, and interferes with the installation of building services.

4. Use of slab drops

These are a modified form of column head.

Shear reinforcement, when required, is normally accomplished by providing reinforcing members either at an angle or laterally to the main flexural reinforcement. In thin structural elements, such as flat slabs, anchoring of short lengths of shear reinforcement is a major design problem. The problem is aggravated by the fact that normal shear reinforcement cannot be placed above the top layer of flexural reinforcement without reducing either the durability, or the efficiency, of the flexural reinforcement. In addition, there is the practical problem of supporting the shear reinforcement during the construction stages.

Recently a new system has been introduced by Square Grip Limited, designated the Shearhoop (registered trade mark) system, which consists of assembly of specially shaped links (shear leg bobs) and hoop reinforcing bars. The hoops are available in a range of sizes and can be combined to form a complete system extending outwards from the column to the zone where the shear resistance of the concrete slab alone is adequate.

In the construction of a slab using Shearhoop (RTM) hoops, bars B1, B2 for the bottom layer of reinforcement are first laid down and the hoops placed over them in the appropriate location. Top reinforcement T2 is then positioned on chairs and the bars overlapping the hoops fully located under the ends of the shear leg bobs extending from the hoops. Finally the top reinforcement T1 is placed over the entire structure.

Whilst the Shearhoop (RTM) system is an improvement on previous arrangements, the hoops still cannot be anchored above the top layer of reinforcement T1 and thus do not provide the best possible shear reinforcement.

From the above, it is apparent that, although much effort has gone into the design of reinforcing systems that address some of the above mentioned problems, none of them provide a complete solution. Although prepackaged reinforcing systems offer some time savings over the in-situ steel fixing solutions, they are nevertheless more expensive in terms of materials and other resources, such as labour and crane time. Some of the other prior art proposals are also of questionable effectiveness, or produce an unquantifiable increase in flexural capacity.

There is a need, therefore, for an improved reinforcing system to impart better shear resistance, without increasing the thickness of the slab. An additional advantage would be to provide a shear reinforcement system enabling thinner slabs to be used.

U.S. Pat. No. 4,854,106 describes foundations for buildings and like structures employing steel reinforcement. A hook leg has an elongate member bifurcated at each end longitudinally of the member to form a pair of extensions with a slot there between, the distal portion of the extensions being bent into a curved form extending transversely of the member to form hooks adapted to resiliently engage of pair of reinforcing rods in the reinforcement, the slots in the unbent portions of the extension being adapted to receive a second pair of reinforcing rods extending transversely of the first pair, whereby to fix the rods in spaced alignment. There is no mention of shear reinforcement.

U.S. Pat. No. 4,472,331 describes are inforcing framework for a concrete building structure in which column and beam reinforcing bars are inserted into holes in reinforcement frames disposed at predetermined intervals. Shearing reinforcement bands, formed by bending a steel strip into a rectangular frame shape, are disposed between adjacent reinforcement frames and secured to wooden sheathing boards by nails. The construction requires access to all sides of the column or beam, and the protruding nails would give rise to potential corrosion problems.

DE 3331276 describes shear reinforcement elements for column supported flat slabs or beams of reinforced or prestressed concrete, which consist of flat steel strips which are undulating in at least two dimensions and transverse to the main surface of the flat slab or beams. The shear reinforcement elements are used in place of conventional round reinforcing bars.

GB-A-292267 describes a method of securing top and bottom reinforcement cages in a road foundation where crossed rods from one cage are secured by a locking member arranged parallel to one of the rods and formed with a looped crutch into which the rods of the cage are threaded. The locking member then extends across to the parallel cage where a similar arrangement locks the rods of that cage together.

SUMMARY OF THE INVENTION

The present invention provides a shear failure reinforcing system for structural elements, in which thin elongate strips of high stiffness material and anchored around a layer of conventional reinforcement, and/or are anchored around a plurality of layers of conventional reinforcement, such that the strips tie the structural element and improve its resistance to shear failure. In preferred embodiments, the strips are anchored around the outermost reinforcing members of a layer of layers of reinforcement, to give improved shear resistance.

In one aspect, the invention provides a method of providing shear reinforcement for a reinforced structural element having reinforcing members located adjacent its major surfaces, which comprises disposing from one major surface of the structural element of plurality of thin elongate strips of high stiffness material such that they anchor around one or more of the reinforcing members adjacent one major surface, and/or around one or more reinforcing members adjacent each major surface, such that the strips tie the structural element and improve its resistance to shear failure.

In another aspect the invention provides a reinforced structural element having reinforcing members located adjacent its major surfaces, wherein shear reinforcement is provided by a plurality of thin elongate strips of high stiffness material disposed from one major surface, and/or around one or more reinforcing members adjacent each major surface, such that the strips tie the structural element and improve its resistance to shear failure.

DETAILED DESCRIPTION OF THE INVENTION

The reinforced structural element may be cast in-situ or precast, and may be provided with any suitable longitudinal reinforcement comprising elongate reinforcing members, which may be initially unstressed, pre-stressed, or post-tensioned. The invention finds particular application where the reinforced structural element is a slab structure especially a flat slab, although it can also be a waffle or ribbed slab, a slab with downstands, a foundation slab or footing, or a staircase slab. Other possible uses may be in a wall, a wide band beam, or normal beam, a normal or extended column, a box or other hallow shape, or a shell or other three dimensional shape. The element may be with or without openings, as desired. The reinforcing structural element may have any suitable thickness, depending upon the application. Henceforth the invention will be more particularly described with reference to thin reinforced concrete structural elements, for example flat slabs, having a thickness of from 10 to 80 cms, more particularly from 10 to 30 cms, but it is to be understood that although the invention has particular advantages when applied to such structures, it is not limited thereto.

The thin reinforced concrete structural element may have any desired length and width, but reinforced flat slabs used in conventional building construction are often of a size of from 1 to 10 meters in length and from 1 to 10 meters in width.

The reinforcing members will usually be elongate rods or bars embedded in the structural element and lying parallel to the major surfaces of the element. The reinforcing members can have any suitable cross-section, for example round, square, or rectangular. Typically, the reinforcing members lie adjacent one or more of the major surfaces of the structural element, and comprises series of reinforcing bars laid at right angles to each other.

The major surfaces of the structural element will normally be the top and bottom surfaces, where the element is a slab, but they could also be the side surfaces of a wall.

The material of the reinforced concrete structural element may be normal concrete, high strength concrete, light weight concrete, concrete with special cements and aggregates, polymer modified concrete, special cement mortar, special polymer mortar. Elements formed from other suitable materials able to be cast which require strengthening in shear, such as, for example, fibre reinforced plastics and ceramics can also be used.

The thin elongate strip of high stiffness material preferably has dimensions such that it will not radically change the overall thickness of the structural members to which it is anchored, and such that it will not break when bent to the required shape, which could be around tight corners. Preferably the strip has a thickness of from 0.5 to 1.0 mm and a width of from 10 to 30 mm. The material of the strip is preferably a high tensile, high stiffness material, such as, for example, high tensile steel, although other high stiffness materials, for example structural polymers such as polypropylene and fibre reinforced plastics comprising, for example, carbon fibre, glass fibre and aramids, are not excluded. The material is required to have high stiffness in order to be able to arrest the development of shear cracks at low strains, and, for example, a material of stiffness of from 100 $KN/mm^2$ to 210 $KN/mm^2$ is preferred. High strength material is preferred for the strips because a lower volume of strip material can be used. A typical strength for a high tensile steel used for the strip can be, for example, from 460 $N/mm^2$ to 1500 $N/mm^2$. Special hardness strips may be useful when dealing with walls in safe areas.

The durability of the strip may be improved by adequate cover, by special surface protection, or by using non-corrosive materials such as stainless steel, or fibre reinforced plastics. Where the strip is metallic, it may also be charged to provide cathodic protection.

Punched holes, embossments and indentations in the strip, as well as special bending, twisting or surface treatment of the strip, can help the overall bond characteristics of the strip to the material of the structural element, although a right angle bend may be sufficient to anchor the strip where concrete is used as the material for the reinforced structural element.

In use, the strip may be disposed in a vertical, horizontal, or inclined direction, and may be bent or clipped around the reinforcing member to which it is anchored, or tied thereto. In a preferred aspect of the invention, the strip is anchored around one or more of the outermost reinforcing members, that is, those members closest to the major surfaces of the structural element. Since the reinforcing bars are often of significant thickness, for example, around 20 mm diameter, this provides shear reinforcement to a point closer to the surface than has been possible hitherto.

Bending and shaping of the strips to the desired shape may be readily accomplished by hand, or by the use of specialised automated or semi-automated equipment. The strips may be preformed before conveying to the site, and use, if desired.

The strips may be anchored in the material of the structural element by providing an appropriate extra strip length beyond a bend around a structural element, or alternatively ends of the strip may be secured together by metal clips, rivets or other fixing means.

The strip can, for example, be bent into a zig-zag shape, a castellated shape, a sine wave curved shape, or other repeating straight sided or curved shaped and then dropped into position on the reinforcing members. This greatly facilitates assembly, where it is often difficult to obtain all round access to the structural element.

Preferably the strips are arranged such that they are totally enclosed within and not exposed at any point on the surface of the structural element, and are not connected to any metal fixing, for example, a nail or screw, which is exposed on the structural element surface. This is to avoid the risk of corrosion or deterioration of the strips in service.

Structural elements reinforced by the method of the invention can have improved strength and substantially improved ductility, imparting improved resistance to shear failure. In addition, structural elements reinforced in accordance with the invention can have a thinner section then those hitherto specified because of their improved resistance to shear failure.

BRIEF DESCRIPTION OF THE DRAWINGS

In order that the invention may be better understood, preferred embodiments thereof will now be described in detail, by way of example only, with reference to the accompanying Drawings in which:

Referring now to FIGS. 1A–1F, in FIG. 1A there is shown a flat element 1, supported on a column 7 about a centre line $C_L$, having upper reinforcing bars, 2, 3, arranged at right angles to each other, and lower reinforcing bars 4, 5 similarly arranged. U-shaped strips 6 of thin, elongate high stiffness steal are arranged between the upper and lower reinforcing bars in order to provide double spaced vertical shear reinforcement.

In FIG. 1B there is shown a curved reinforced concrete element 10, supported on columns 16, having upper reinforcing bars 11, 12 and a lower reinforcing bar 13. A thin strip of 14 of high stiffness steel is bent around the upper reinforcing bars 12 and the lower reinforcing bar 13 to provide single spacing vertical strip shear reinforcement. The strip 14 is bent at its ends 15 around the lower reinforcing bar 13, leaving a substantial length of the strip for anchoring in the concrete.

FIG. 1C shows a flat concrete structural slab 20, supported on a column 21 about a centre line $C_L$, and having upper reinforcing bars 22, 23, and lower reinforcing bars 24, 25. In this case the thin, high stiffness metal strip 26 is bend around both upper and lower reinforcing bars.

In FIG. 1D there is shown a flat reinforced concrete slab 30, supported upon a column 31, and provided bars 34, 35. Shear reinforcement is provided by the metal strip 36 which is bent around upper and lower reinforcing bars so as to provide inclined shear reinforcement.

FIG. 1E shows an inclined concrete reinforcing slab 40, supported on a column 41, and provided with upper reinforcing bars 42, 43 and lower reinforcing bars 44, 45. Shear reinforcement is provided by the high stiffness metal strip 46 which is bent around both upper and lower reinforcing bars to form a singles paced shear reinforcement.

FIG. 1F shows a vertical concrete structural slab 50 having rightside reinforcing bars 51, 52 and left side reinforcing bars 53, 54. Shear reinforcement is provided by the high stiffness metal strip 55 which is bent around both left and right side reinforcing bars to provide inclined shear reinforcement.

The invention will now be illustrated by the following examples:

EXAMPLE 1

This example describes the enhancement of shear capacity of a flat slab with inclined metal strip reinforcement having punched holes.

Figure 1A:
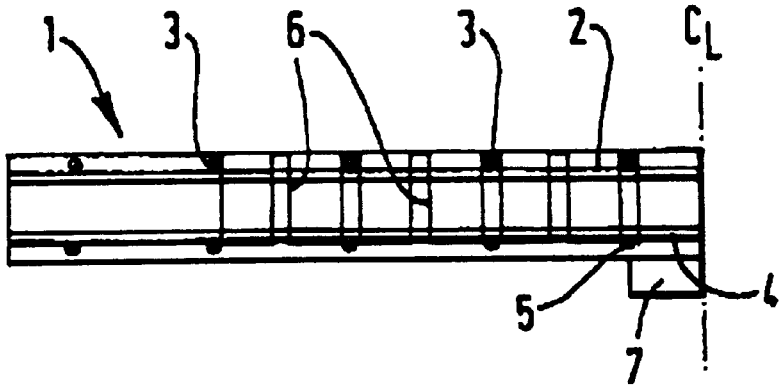
FIG. 1A shows schematically a sectional side elevation of are inforced flat structural element according to the invention.
Figure 1B:
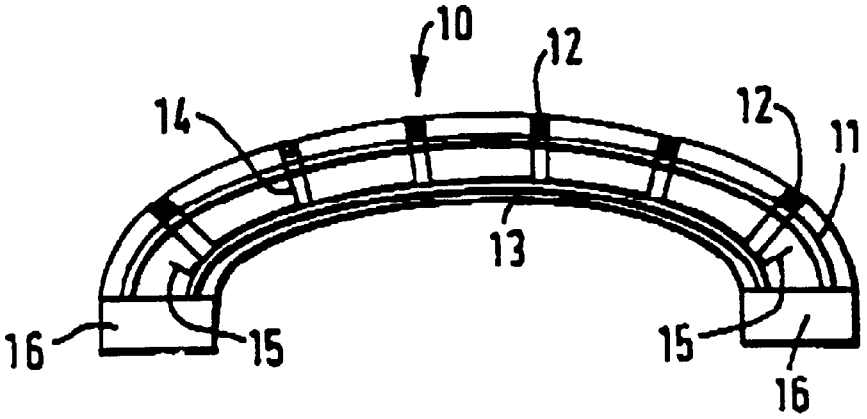
FIG. 1B shows a sectional side elevation of a reinforced curved structural element according to the invention.
Figure 1C:
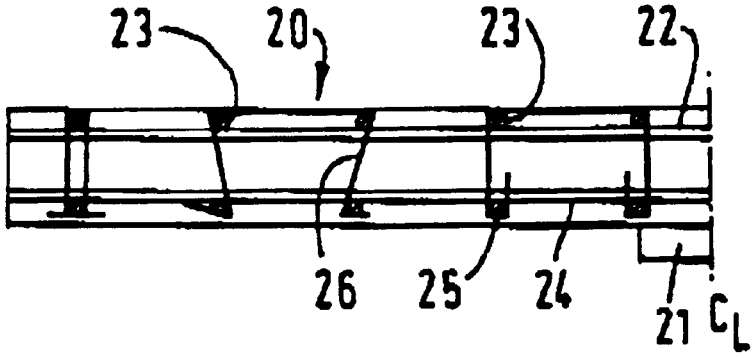
FIG. 1C shows a sectional side elevation of a reinforced flat structural element according to the invention in which the strip is anchored to both top and bottom reinforcing members.
Figure 1D:
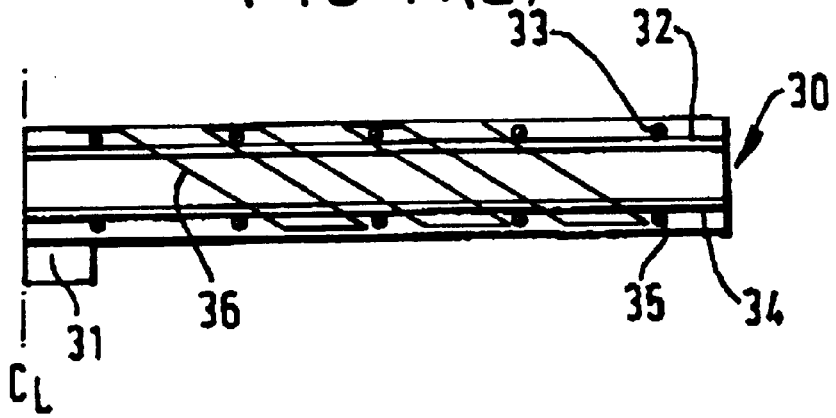
FIG. 1D shows a sectional side elevation of a reinforced flat structural element according to the invention reinforced with single spacing inclined strip.
Figure 1E:
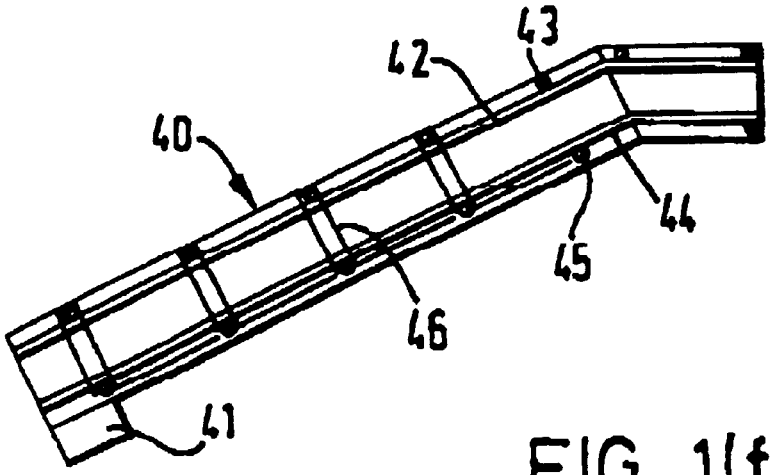
FIG. 1E shows a sectional side elevation of an inclined reinforced structural element according to the invention.
Figure 1F:
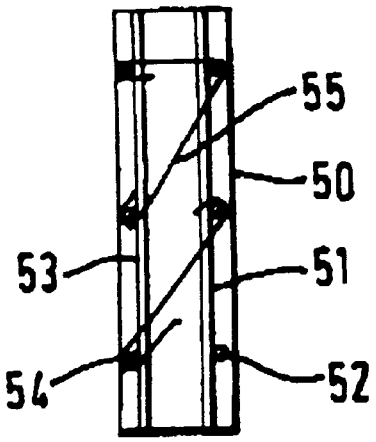
FIG. 1F shows a sectional side elevation of a vertical reinforced structural element according to the invention.
Figure 2:
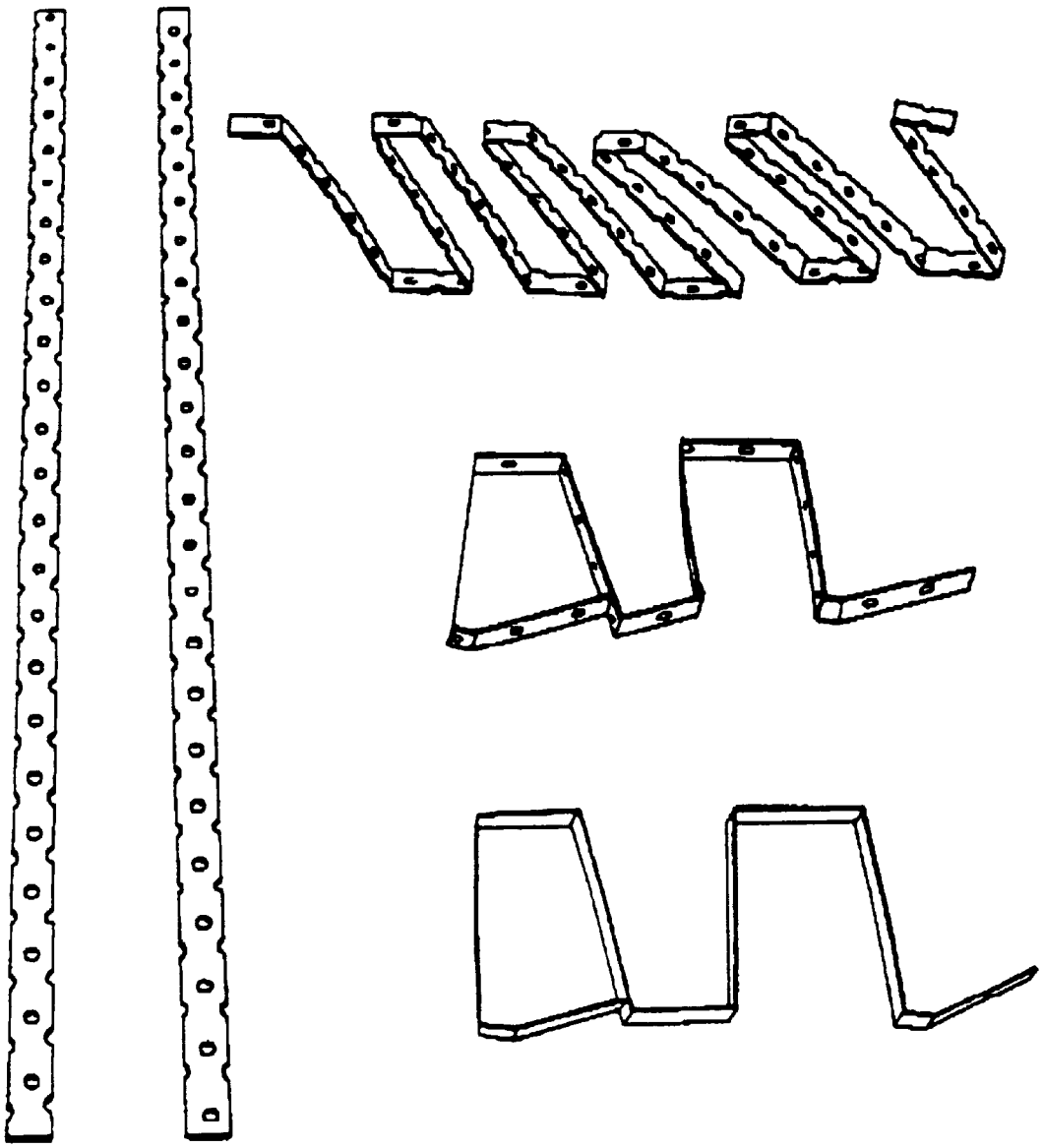
FIG. 2 shows examples of punched are pre-formed steel strips for use in the invention.
Figure 3A:
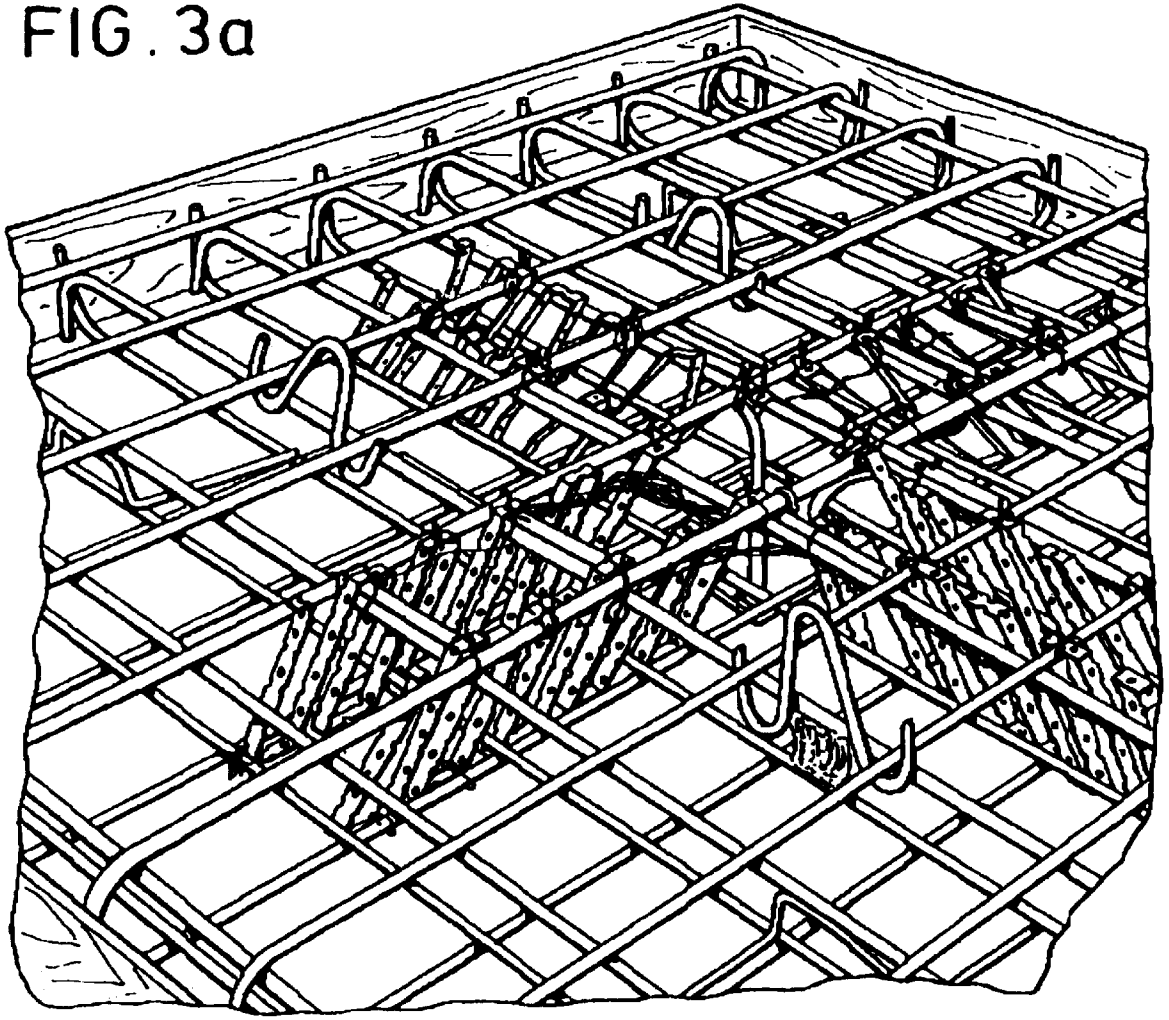
FIG. 3A shows a perspective view from the top and one side of the reinforcing formwork of a flat reinforced concrete structural slab in accordance with the invention, reinforced with inclined metal strips with punched holes.

Steel strips are produced having a series of punched holes as shown in FIG. 2, and are preformed to the castellated shape shown therein. The strips are arranged in the formwork for a concrete slab in locations determined by using British Standard BS8110 (1985), as illustrated in FIG. 3A. It will be noted that it is only necessary to have access to the top side of the formwork in order to place the strips in position. Concrete is then poured to produce a slab of thickness 175 mm which is below the 200 mm limit imposed by BS8110 on the thickness of flat slabs.

Figure 4A:
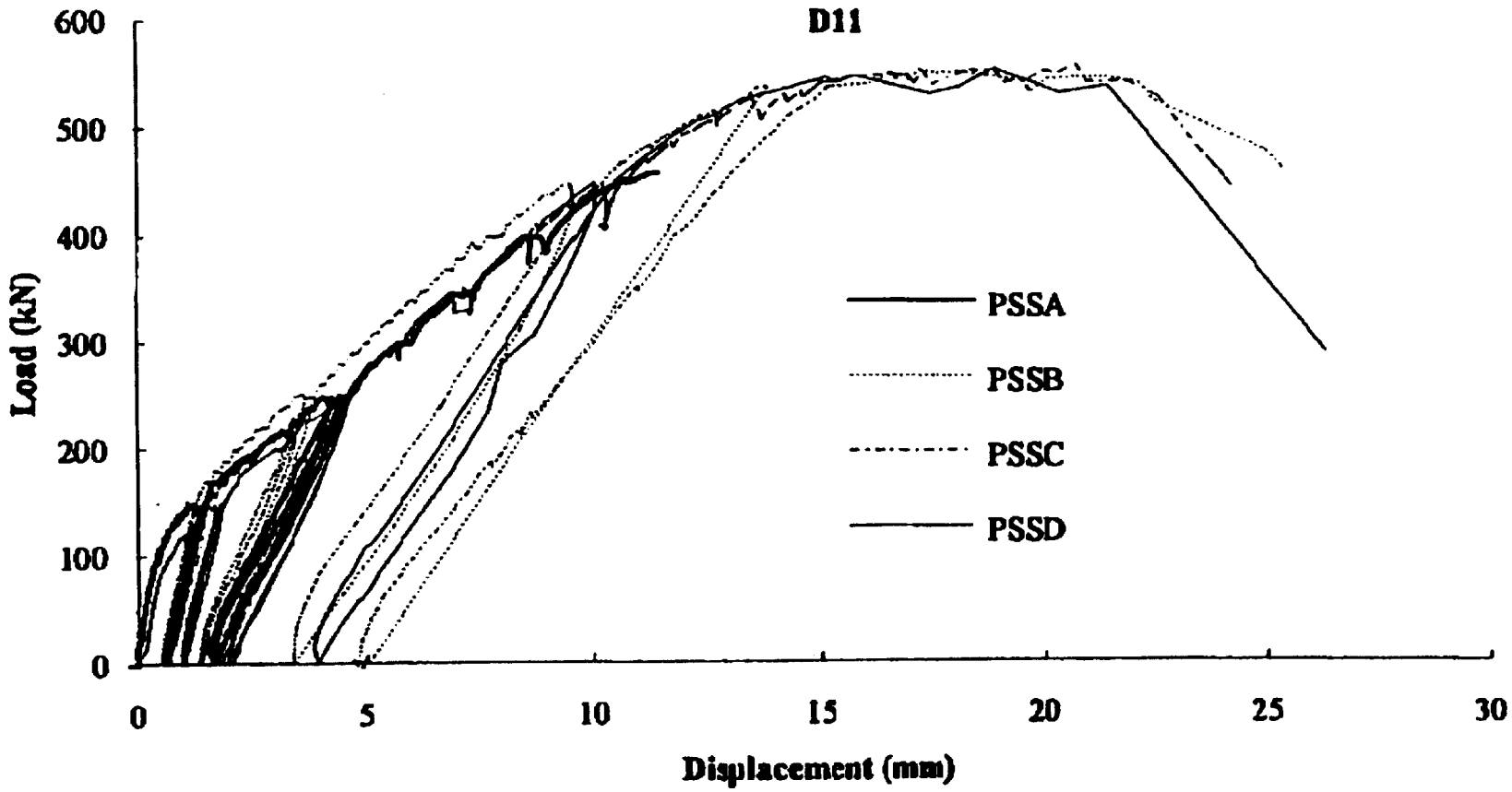
FIG. 4A shows the load versus deflection curves for the slabs of FIGS. 3A to 3C (PPSB to PPSD) in comparison with an unreinforced control slab (PPSA)
Figure 4B:
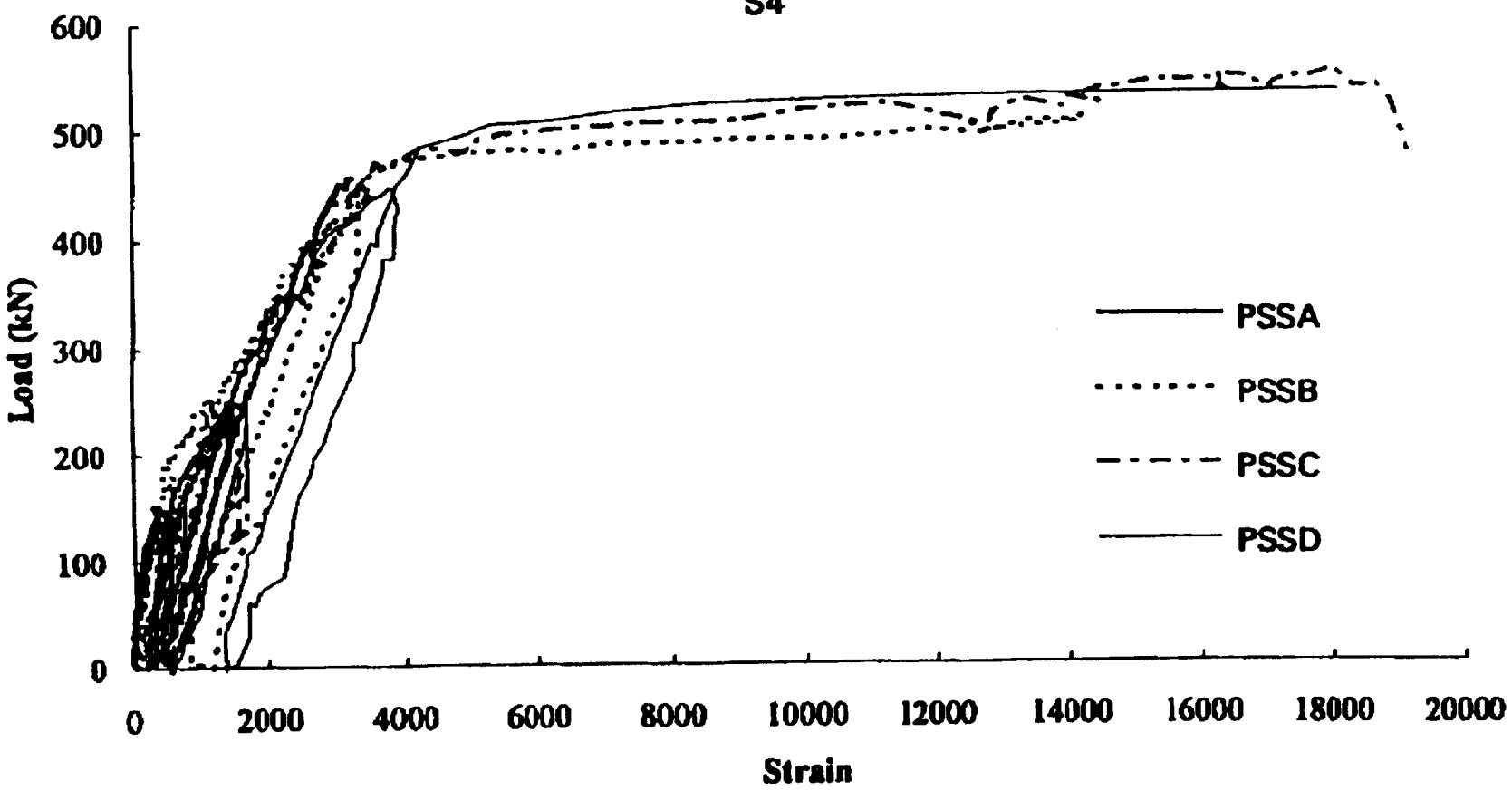
FIG. 4B shows the load versus strain in the flexural reinforcement for the slabs of FIGS. 3A to 3C (PPSB to PPSD) in comparison with an unreinforced control (PPSA).

The slab (B) was tested with an eight-point load arrangement, simulating loading typical of flat slabs in buildings of conventional construction. The load versus deflection curves and the load versus strain in the flexural reinforcement curves for this slab and others tested for comparison are shown in FIGS. 4A and 4B respectively.

Slab (A) was reinforced and failed in abrupt punching shear mode at a load of 460 kN. Slab (B) deflected considerably more, developed very large strains in the longitudinal reinforcement and failed in a ductile mode at a maximum load of 560 kN, in the fashion desired in practice by structural engineers.

EXAMPLE 2

This example demonstrates the increase in load and ductility of a flat slab reinforced with inclined steel strip.

Figure 3B:
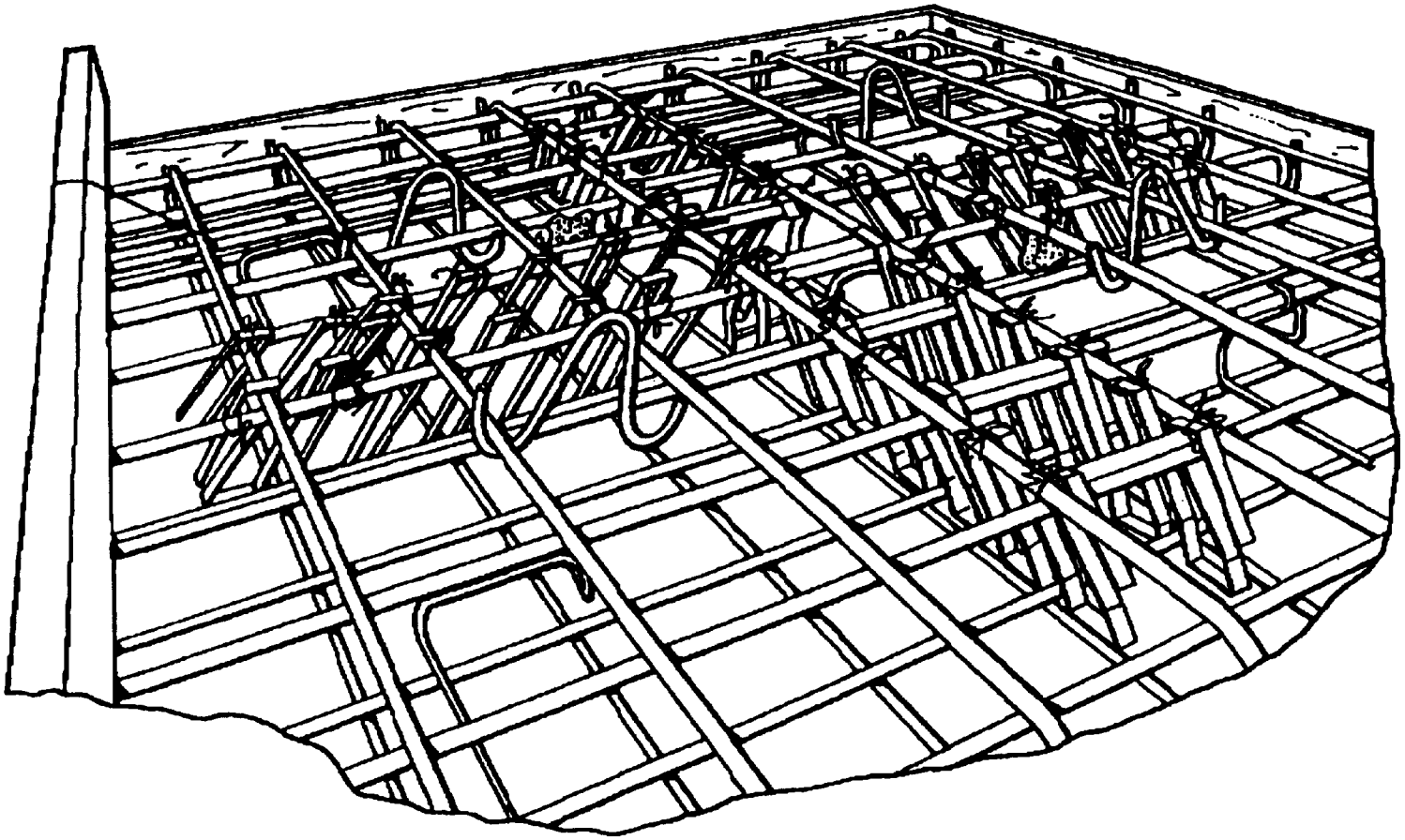
FIG. 3B shows a perspective view from the top and one side of the reinforcing formwork of a reinforced flat concrete structural slab in accordance with the invention, having inclined metal strip shear reinforcement, but without punched holes in the strips.

Steel strips without the punched holes are preformed as shown in FIG. 2 and arranged in the metal formwork for a concrete slab in locations determined by using BS8110 (1985) as illustrated in FIG. 3B. Concrete is then poured to produce a slab of thickness 175 mm.

The slab (C) was tested with an eight-point load arrangement, making extra allowance for anchoring the strip at its ends. The load versus deflection curves and the load versus strain in the flexural reinforcement curves for this slab and others tested for comparison are shown in FIGS. 4A and 4B respectively.

Slab (C) deflected considerably more than slab (A), and developed very large strains in the longitudinal reinforcement, failing in a ductile mode at a maximum load of 560 kN.

EXAMPLE 3

This example demonstrates the increase in load and ductility of a flat slab reinforced with vertical steel strip reinforcement anchoring both layers of longitudinal reinforcement.

Figure 3C:
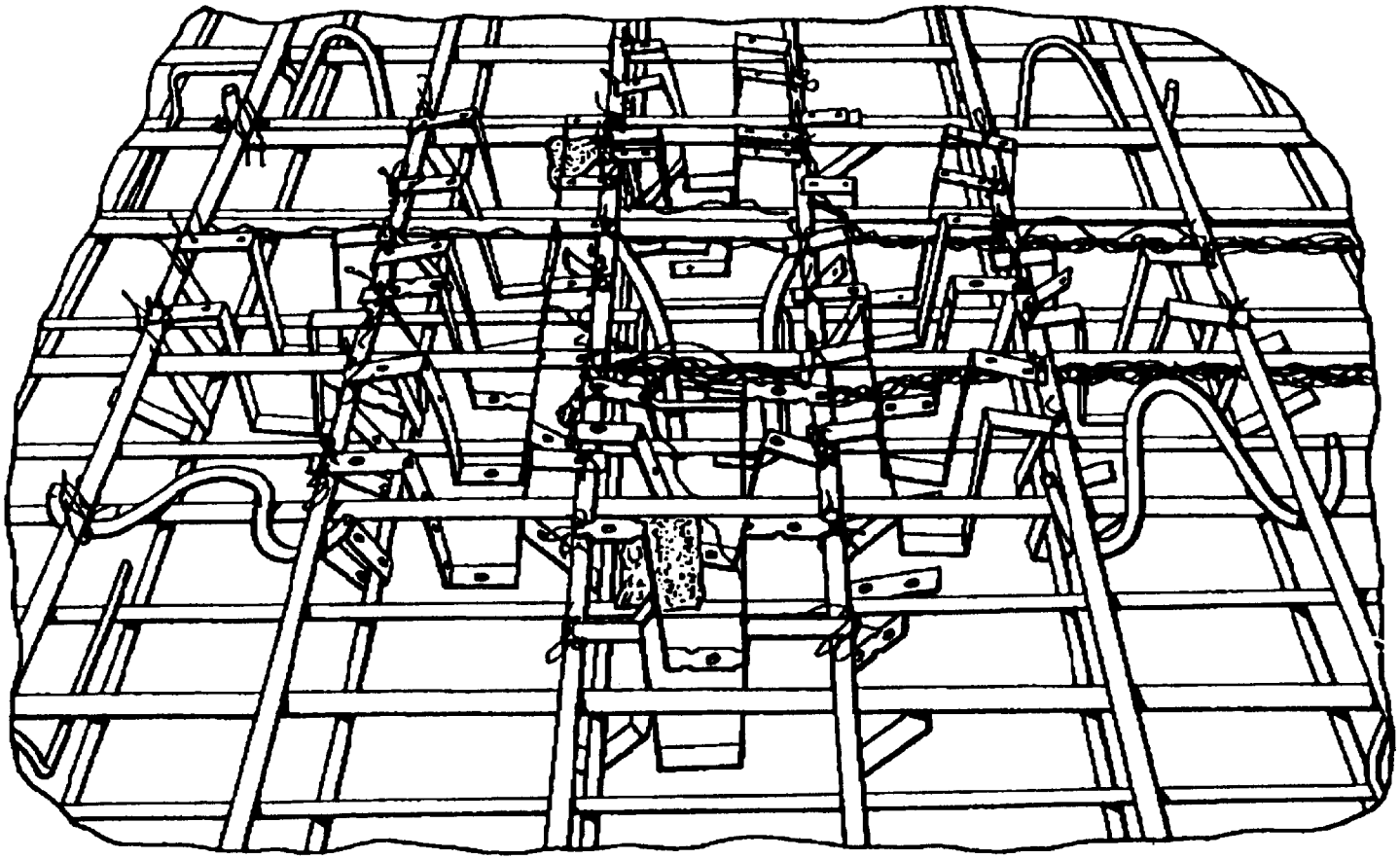
FIG. 3C shows a perspective view from the top and one side of the reinforcing formwork for a reinforced flat concrete slab in accordance with the invention, having shear reinforcement comprising vertically arranged metal strips with punched holes.

Steel strips, punched and pre-formed as shown in FIG. 2, are inserted into the form work of a concrete slab as shown of FIG. 3C and anchored to the upper and lower layers of longitudinal reinforcing bars. The strips are arranged in locations determined by using BS8110 (1985). Concrete is then poured to produce a slab of thickness 175 mm.

The slab (D) was tested with an eight-point load arrangement, simulating loading typical of flat slabs in buildings. Extra allowance was made for anchoring the strip at its ends. The load versus deflection curves and the load versus strain in the flexural reinforcement curves for this slab and others tested for comparison is shown in FIGS. 4A and 4B respectively.

Slab (D) deflecting considerably more than slab (A), developed very large strains in the longitudinal reinforcement, and failed in a ductile mode at a maximum load of 560 kN.

What is claimed is:

1. A method of forming a reinforced structural element potentially subject to concentrated shear forces in a first direction, which method comprises:

providing spaced first and second reinforcing structures disposed substantially perpendicular with respect to said first direction, each structure comprising reinforcing elements formed as a network including gaps between said reinforcing elements;

disposing from a direction opposite said first direction and from one side of said first reinforcing structure a plurality of thin elongate strips of high stiffness material, said strips being undulating so as to have at least one peak having a lowermost portion of either side of the peak;

anchoring the strips around the reinforcing elements of said first reinforcing structure by engagement of said peak with a reinforcing element thereof without additional structural connection of said strips to said reinforcing element, said lowermost portions passing through said gaps in the first reinforcing structure so as to lie adjacent said second reinforcing structure, the strips having no two peaks anchored to reinforcing elements of the first reinforcing structure which are joined via adjoining lowermost portions wherein such adjoining lowermost portions are structurally connected to the second reinforcing structure; and casting structural material around said first and second reinforcing structures and around said strips to embed said structures and strips in said material, the strips being arranged to provide shear reinforcement for the structural element in the event of the element being subjected to concentrated shear forces in said first direction.

2. A method according to claim 1, in which the reinforced structural element is a flat slab.

3. A method according to claim 2, in which the reinforced structural element is a reinforced concrete element.

4. A method according to claim 2, in which the reinforced structural element has a thickness of from 10 to 30 cms.

5. A method according to claim 2, in which the reinforced structural element has a length of from 1 to 10 m and a width from 1 to 10 m.

6. A method according to claim 1, in which the reinforcing elements comprise a series of reinforcing bars laid at right angles to each other.

7. A method according to claim 1, in which the elongate strips of high stiffness material have a thickness of from 0.5 to 1.0 mm and a width of from 10 to 30 mm.

8. A method according to claim 1, in which the material of the elongate strips comprises high tensile steel.

9. A method according to claim 1, in which the material of the elongate strips has a stiffness of from 100 $KN/mm^2$ to 210 $KN/mm^2$ and a strength of from 460 $N/mm^2$ to 1500 $N/mm^2$.

10. A method according to claim 1, in which the elongate strips are provided with holes along the lengths thereof to assist the overall bond characteristics of the strips to the material of the structural element.

11. A method according to claim 1, in which the strips have ends and the ends of the elongate strips are bent or clipped around reinforcing elements of the first or second reinforcing structures.

12. A method according to claim 1, in which the elongate strips are preformed before use.

13. A method according to claim 1, in which the strips are preformed into a castellated shaped.

14. A method according to claim 1, in which the elongate strips are anchored in the material of the structural element by providing an appropriate extra strip length beyond a bend around a structural element.

15. A method according to claim 1, in which the elongate strips are totally enclosed within the structural element and are not connected to any exposed metal fixing.

16. A reinforced structural element produced by a method according to claim 1.

17. A method according to claim 1, in which each lowermost portion comprises a trough.

18. A method according to claim 1, in which the elongate strips are tied to elements of the reinforcing structure.

19. A method according to claim 1, in which ends of the elongate strips are secured to each other by metal clips or rivets.

20. A method of providing shear reinforcement for a reinforced structural element having reinforcing structures located adjacent its major surfaces, which comprises disposing from one major surface of the structural element a plurality of thin elongate strips of high stiffness material such that they anchor around one or more of the reinforcing elements adjacent one major surface such that the strips tie the stuctural element and improve its resistance to shear failure, wherein the elongate strips are provided with holes along the lengths thereof to assist the overall bond characteristics of the strips to the material of the structural element.

21. The method of claim 20 in which the plurality of thin elongate strips of high stiffness material are anchored around one or more reinforcing members adjacent both major surfaces.

* * * * *